United States Patent [19]

Kirjanov et al.

[11] Patent Number: 4,877,538

[45] Date of Patent: Oct. 31, 1989

[54] SULFOMETHYLATED STAIN BLOCKING AGENTS

[75] Inventors: Alexander S. Kirjanov, Reading, Pa.; Michel A. Herlant, Mount Pleasant, N.C.

[73] Assignee: Crompton & Knowles Corporation, Stamford, Conn.

[21] Appl. No.: 177,110

[22] Filed: Apr. 4, 1988

[51] Int. Cl.[4] ..... D06M 00/00

[52] U.S. Cl. ..... 252/8.7; 8/115.6; 8/490; 8/560; 8/589; 252/8.75; 252/8.9; 427/393.4; 428/96; 428/267; 428/270

[58] Field of Search ..... 8/560, 589, 490, 115.6; 252/8.7; 427/393.4; 428/96, 267, 270

[56] References Cited

U.S. PATENT DOCUMENTS 3,788,808 1/1974 Falkehag et al. ..... 8/524

4,302,202 11/1981 Sumner et al. ..... 8/455

4,306,876 12/1981 Hertel ..... 8/527

4,592,940 6/1986 Blyth et al. ..... 428/96

4,619,853 10/1986 Blyth et al. ..... 428/95

*Primary Examiner*—A. Lionel Clingman

*Attorney, Agent, or Firm*—Bernard Francis Crowe

[57] ABSTRACT

This invention relates to a new process and group of products that are useful in preventing nylon and wool fibers, including carpeting and upholstery, from being permanently stained. Fibers can be permanently stained by food colors contained in food spilled on the fiber. This new group of sulfomethylated phenol-formaldehyde or naphthol-formaldehyde and anionic surfactant compounds not only block the stain from the fiber but also minimize any yellowing or discoloration of the treated fibers during the application and during the subsequent exposure to sunlight or commonly used lightfastness testing equipment.

19 Claims, No Drawings

SULFOMETHYLATED STAIN BLOCKING AGENTS

BACKGROUND OF THE INVENTION

This invention relates to a new group of compositions that are useful in preventing nylon and wool fiber and fabrics made from them, including carpeting and upholstering materials, from being permanently stained by food colors contained in foods spilled on the fiber. This new group of sulfomethylated phenol-formaldehyde or naphthol-formaldehyde and anionic surfactant compositions not only block the stain from adhering to the fiber but also minimize any yellowing or discoloration which ultimately deteriorates the lightfastness typically caused by phenol-formaldehyde or naphtol-formaldehyde condensates.

Heretofore, fibers were treated with acid dye fixing agents, such as INTRATEX ®N, to block the dyeing sites on the fiber. This type of sulfonated phenol-formaldehyde condensates prevented the fibers from becoming "dyed" with the food colors, such as FD&C Red 40 in KOOL-AID ®. Additionally, flurocarbon finishes such as ZEPEL ® and SCOTCHGUARD ® are known to repel water-borne and oil-borne stains, and are usually applied after dyeing, unless they are built into the greige fiber. These finishes, however, do not afford a satisfactory protection against food colors, which is the reason for using Food Color Stain Blocking Agents in addition to the fluorocarbon Finishes.

INTRATEX N, as many other such fixing agents, tend to slightly yellow or discolor the fiber while affecting, at the same time, its lightfastness. This fact alone limits the amount which can be applied to the fiber, since the amount of yellowing is in direct proportion to the percent of active ingredient exhausted onto the fiber, and this limiting amount is frequently not sufficient to produce the desired stainblocking effect.

Likewise, fibers have been treated with anionic surface active agents such as CENEGEN ®7. These surfactants afford little stain blocking ability to the treated fibers but cause minimal yellowing with no deleterious effects on the lightfastness of the fibers at concentrations of about 0.5%–3.0%.

U.S. patent application Ser. No. 07/064,856 filed June 19, 1987 teaches the use of a group of sulfonated phenol formaldehyde or naphthol formaldehyde condensates and anionic surfactant compositions to prevent nylon and wood fibers, and fabrics made from them, including carpeting and upholstery materials, from being permanently stained by food colors contained in foods spilled on the above materials.

In practicing the above art in textile mills, it is frequently preferred, when applying the compositions, to use soluble alkaline earth salts, especially magnesium sulfate (due to its relatively low cost and ample availability), most often in the form of Epsom Salts, in order to achieve a complete exhaust, or full deposition of said compounds from the treatment bath onto the substrate being treated. The reason for this practice is to achieve the most complete possible utilization of the stain blocking compound for economic reasons as well as for environmental reasons, i.e. to keep chemicals content of the effluing bath to a minimum.

Unfortunately many of the above stainblocking agents are not stable or their stability is shortlived with magnesium sulfate and with other alkaline earth metal salts, in acid conditions. In such cases the treatment bath must be discarded before its complete utilization, and a new one prepared.

This problem is overcome by formulating the said stain blocking agents, such as the group of products of U.S. patent application Ser. No. 07/064,856, file June 19, 1987, with the acid forms of anionic surface-active agents, included in the above U.S. patent application.

Thus, an acid stable stainblocking agent can be made within the parameters of the prior art including sulfonated phenol-formaldehyde or naphthol formaldehyde condensation products. Unfortunately, in the process of formulating the above compositions with the free acid form of the anionic surface active agents, it is necessary to use relatively high amounts of solvents, such as diglycols, glycol ethers, and other hydroxylated solvents, in order to keept he resulting product storage-stable in the form of a homogeneous solution. In addition, this formulation adjustment adds too many inactive ingredients diluting the stainblocking activity of the product.

SUMMARY OF THE INVENTION

The present invention provides an improved stain blocking agent for nylon and wool carpets that minimizes the yellowing of the fiber when exposed to sunlight. Specifically, the addition of a sulfomethylated phenol-formaldehyde or naphthol-formaldehyde condensate to an anionic surfactant produces a synergistic effect capable of blocking food color stains on carpets. This synergistic effect not only produces low initial yellowing but also good light fastness of the substrate.

To overcome deficiencies of the prior art and eliminate the dilution problem, an improved stain blocking product, sulfomethylated phenol formaldehyde (or naphthol formaldehyde) condensate was introduced. These sulfomethylated derivatives are more stable alkaline earth salts in acid conditions and require relatively small amounts of solvents to make them stable in the above mentioned conditions. Moreover, the dilution factor of the smaller amount of such solvents is completely compensated for, with regard to the stain blocking, by the free acid form of the anionic surface active agent comprising the finished stain blocker.

In addition to being stable in soluble alkaline earth salts under acid conditions, the composition of this invention was found to convey much less stain to the polyamide substrate treated than the compositons of the prior art, maintaining however, the same desirable lightfastness and stainblocking properties. The lesser staining is desirable in practice because it will keep the color of the substrate from drifting away from the required commercial shade standard.

The coloration or stainage obtained with FDA Acid Red 40 can be explained essentially as a dyeing phenomenon, with FDA Acid Red 40 having an affinity for the amino groups ($—NH_2$) in the polyamide fiber. A salt bond between the dye and the amino group is obtained due to the presence of citric or phosphoric acids in soft drinks and in products such as KOOL-AID ®. The acidity of these drinks is in the area of pH=2.8–3.0 and activates the $—NH_2$ groups to $—NH_3$ (positive) and this increases dramatically the affinity of acid dyes for the fiber (FDA Acid Red 40 contains a $—SO_3$ (negative) grouping).

The concept of blocking the amino groups and rendering them inaccessible to acid dyes is not new. What is new is the ability to combine two products, one a sulfomethylated phenol-formaldehyde or sulfomethylated naphthol-formaldehyde condensate and the other an anionic surfactant in order to produce a synergistic effect and at the same time obtain a produce which is stable to alkaline earth salts in acid conditions.

PREFERRED EMBODIMENTS OF THE INVENTION

The sulfomethylated derivative used in this invention can be described as follows:

$$[R]_n—CH_2SO_3M \quad [I]$$

Where R is a phenolic derivative such as naphthol, alkyl naphthol, thiodiphenol, alkylthiodiphenol, phenol, alkyphenol, 4,4'-dihydroxydiphenyl sulfone, alkyl 4,4'-dihydroxydiphenyl sulfone, 4,2'-dihydroxydiphenyl sulfone, alkyl 4,2'-dihydroxydiphenyl sulfone, bisphenol 'A' or alkylbisphenol 'A' and n=1 to 6; and M is H, an alkali metal, —$NH_4$ or an amine (primary, secondary or tertiary).

And the anionic surface active agent has a structure II or III as follows:

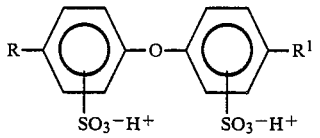

[II]

Where at least one of the radicals $R^1$ and $R^1$ is an alkyl chain, branched or linear, with 4 to 18 carbons, where one of the radicals, $R^1$ or $R^1$, may be H.

$$[R^1]—SO_3^-H^+ \quad [III]$$

Where $R^1$ may be an aliphatic branched or linear chain $C_nH_{2n+1}$ where $n^1$=4 to 18, preferably 10 to 18 carbons or R may also be an alkyl-aryl branched or linear chain

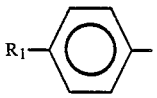

wherein $R_1$ is $C_nH_{2n+1}$, and where $n^1$=4 to 18.

The compositions of the invention consist of a mixture of sulfomethylated compounds named within structure [I] with either anionic surface active agents listed in compound [II] or [III], and a suitable glycol or glycol ester type solvent acting as hydrotrope.

The preferred mixture consist of from 1 to 50 parts of compound [I] to 1 of either compounds [II] and [III], and in addition a solvent such as ethylene glycol, diethylene glycol, propylene glycol equivalents, and their esters, or other hydrotropically-acting hydroxylated solvents, in an amount of from 2 to 25% by weight of the mixture of [I] with [II] or [III].

The most preferred ratios being [I]:[II] or [I]:[III] equal to from (3 to 8):1 with 4 to 15% of the hydrotropically-acting solvent by weight based on the weight of the mixture of [I] with [II] or [III].

The procedures for the application of the stain-blocking agents to the carpet can be varied. The following methods can be utilized:

1. Application during exhaust dyeing.
2. As an exhaust aftertreatment following exhaust dyeing.
3. Treatment after exhaust dyeing combined with exhaust application during exhaust dyeing.
4. Application during continuous dyeing.
5. As a continuous aftertreatment.
6. Application during exhaust dyeing combined with a continuous aftertreatment.

Literally, condensation products useful for practicing the process of the present invention are those prepared from relatively inexpensive, commercially available monomers such as phenol, diphenolsulfone, formaldehyde, ortho- and paraphenolsulfonic acid or salts thereof. Instead of, or in addition to formaldehyde, another aldehyde, such as, furfuraldehyde or benzaldehyde may be used. Also, instead of or in addition to a phenol or phenols, a corresponding naphthol or naphthols may be used. Likewise, the anionic surface active agents can be described as:

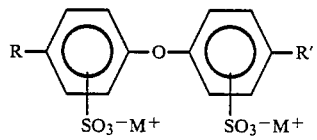

where at least one of the radicals R and R' is an alkyl chain, branched or linear, with 4 to 18 carbons, preferably 10 to 16 carbons. One of the radicals, R or R' may be H. M is H, an alkali metal, $NH_4$ or an amine (primary, secondary, or tertiary). Examples of such are DOWFAX ® 2A1 by Dow Chemical and CONCO ® Sulfate 2A1 by Contenental Chemical. In addition, Alkyl-Aryl Sulfonates such as CONCO ® AAS-40S or Sulframine ® 1298 by Continental Chemical and Witco Chemical Corp., respectively, can be shown as follows:

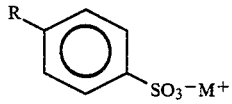

where R is an alkyl chain, branched or linear, with 4 to 18 carbons, preferably 10 to 18 carbons. M is H, an alkali metal $NH_4$ or an amine (primary, secondary or tertiary).

EXAMPLES OF THE INVENTION

The following examples are illustrative of the invention but should not be interpreted as to limit the application nor be all inclusive.

EXAMPLE 1

10 g/l of compound [I] where R is 4,4'-dihydroxydiphenylsulfone and n=2 were mixed in water to which 5 g/l of $MgSO_4$, anhydrous were added. The pH was adjusted to 3 with sulfamic acid. Upon standing, the solution began precipitating within 15 minutes.

EXAMPLE 2

The same compound [I] of Example 2 combined with compound [II] and a glycol was stable at 10 g/l with 5 g/l $MgSO_4$ for at least 24 hours. The composition of this stainblocker was Compound [I]: 33.6%
Compound [II]: 12.2%

Diethyleneglycol: 8.4%
Water: 45.8%

EXAMPLE 3

The same good stability of Example 2 was achieved with the following stainblocker
Compound [I]: 30.0%
Compound [III]: 9.0%
Ethyleneglycol: 16.4%
Water: 44.6%

PROCEDURE FOR TESTING FOOD COLOR STAINBLOCKING EFFECT

The staining solution consisted of a packet of Cherry Kool-Aid ® dissolved in 2 quarts of potable water and 4 tablespoons of granulated sugar. According to the manufacturer, Kook-Aid ® contains Citric Acid, calcium phosphate, artificial color, and Vitamin C. The packet contains 3.9 grams of powder.

The artificial color of this soft drink concentrate is FDA Red 40, an ingredient of many foods. Since FDA Red 40, as many FDA Colors, is an acid dye, it stains nylon, and other polyamide fibers. The acidity of the prepared drink (Citric Acid) aggravates the staining ability, actually a form of cold dyeing, of polyamide fibers.

A 4×4 inch (size is not important) piece of the finished, or unfinished, dry stainblocker substrate (dyed or white; testing was done on white substrate to see the full impact of staining) was saturated in the above solution for 5 minutes, removed, exposed to ambient conditions for 4 hours, and washed with water.

The resulting red stain remaining after a 1 minute water rinse is rated, once the sample has been dried, using the conventional AATCC rating scale system:
1=very heavy stain
5=no stain
Untreated samples were rated 1, in all cases.

TESTING OF LIGHTFASTNESS

Exposure of the substrate is carried out at 40 standard fading units in a Xenon lightfastness tester. The rating system is also based on the AATCC 1-5 scale. The fading on white polyamide appears as a yellowing.

APPLICATION OF STAINBLOCKERS TO POLYAMIDE SUBSTRATES

Although stainblockers can be applied by exhaust or continuous methods; before, during, and after dyeing (as mentioned earlier), all examples presented here used the pad steam technique with subsequent drying for simplicity. The results obtained with the other application methods are exactly the same, provided the amount of stainblocker deposited on the substrate is the same.

40 g tufted, cut pile, duPont Nylon 66, Superba ® set, carpet samples were rinsed, and squeezed to 100% wet pickup of water. The samples were then treated with the stainblocker solutions, containing in addition a commonly used anionic wetting agent, and squeezed to contain 2.5% on weight of carpet of the corresponding stain blocker formulation. The samples were then steamed in atmospheric, saturated steam for ca. 4 minutes, and dried. All treatment baths had their pH adjusted to 2.5 with sulfamic acid; all baths contained 5 g/l of Epson Salt.

EXAMPLE 4

The composition of Example 1 was applied 30 minutes after it was prepared. The procedure was as described above, with the following results:
Kool-Aid Stain Rating: 2
Xenon light Rating: 2-3

EXAMPLE 5

The composition of Example 2 was applied as above, after 24 hrs standing, with the following results:
Kool-Aid Stain Rating: 4-5
Xenon light Rating: 3-4

EXAMPLE 6

The composition of Example 3 was applied as above, after 24 hrs standing, with the following results:
Kool-Aid Stain Rating: 4-5
Xenon light Rating: 3-4

EXAMPLE 7

A first generation product called Intratex N was applied in the same manner as a comparison. This treatment bath was used before it turned turbid (i.e. 20 hrs.). The results were:
Kool-Aid Stain Rating: 4
Xenon light Rating: 3

EXAMPLE 8

When the treating solution of Example 7 was used after 25 hrs. standing, a fine precipitate formed. It was, nevertheless, applied as before to the substrate with the following results:
Kool-Aid Stain Rating: 2-3
Xenon light Rating: 3-4

EXAMPLE 9

In this and the following Example 10 $MgSO_4$ was left out to emphasize the stain blocking synergism and the impact on light-fastness when compounds of types [II] or [III] are combined with compounds [I].

The composition of Example 1 was applied in the same manner as described in Example 4, but without $MgSO_4$. The results were as follows:
Kool-Aid Stain Rating: 4
Xenon Light Rating: 3

EXAMPLE 10

The composition of Example 2 was applied as described in Example 5 but without $MgSO_4$. The results were as follows:
Kool-Aid Stain Rating: 4-5
Xenon Light Rating: 3-4

We claim:

1. A stain blocking composition comprising 1-50 parts a sulfomethylated phenol-formaldehyde or sulfomethylated naphthol-formaldehyde and an 1 part of an anionic surface active agent.

2. The composition of claim 1, wherein the ratio range of the sulfomethylated phenol-formaldehyde or naphthol-formaldehyde condensates to the anionic surface active agents is 1:1 to 50:1.

3. The composition of claim 1, comprising sulfomethylated phenol-formaldehyde or naphthol-formaldehyde derivatives of the formula:

$$[R]_n \rightarrow CH_2SO_3M \qquad [I]$$

Where R is a phenolic derivative such as naphthol, alkyl naphthol, thiodiphenol, alkyl thiodiphenol, phenol, alkylphenol, 4,4'-dihydroxydiphenyl sulfone, alkyl 4,2'-dihydroxydiphenyl sulfone, bisphenol 'A', alkylbisphenol 'A' and n=1 to 6; and M is h, an alkali metal, —$NH_4$ or an amine (primary, secondary or tertiary).

4. The composition of claim 1, wherein the anionic surface active agent is:

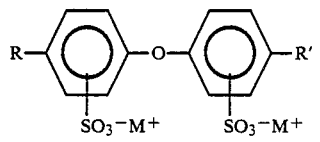

where at least one of the radicals, R and R', is an alkyl chain, branched or linear, with 4 to 18 carbons, where one of the radicals, R or R', may be H, and where M is H, or an alkali metal or $NH_4$ or an amine.

5. The composition of claim 1, wherein the anionic surface active agent is:

$$[R]—SO_3^-H^+ \qquad [III]$$

Where R may be an aliphatic branched or linear chain $C_nH_{2n+1}$ where n =4 to 18, preferably 10 to 18 carbons or R may also be an alkyl-aryl branched or linear chain

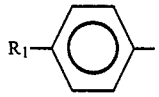

where $R_1$ is $C_nH_{2n+1}$, and where n=4 to 18.

6. The composition of claim 1, wherein the anionic surface active agent is an alkyl-aryl sulfonate of the following formula:

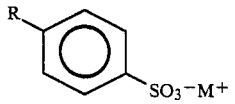

where R=alkyl chain, branched or linear, with 4 to 18 carbons and M=H, or an alkali metal, or $NH_4$ or an amine.

7. The composition of claim 1, wherein the anionic surface active agent is a non-aromatic sulfonate including alcohol sulfates and alfa-olefin sulfonates.

8. The composition of claim 1 comprising 2 to 25% by weight of ethylene glycol, diethylene glycol, propylene glycol or esters of the above.

9. A process for preventing fibers from being permanently stained comprising applying to the fibers stain blocking composition including the addition of an anionic surface active agent to a sulfomethylated phenol-formaldehyde or sulfomethylated naphthol-formaldehyde condensate.

10. The process of claim 9, wherein the ratio range of the sulfomethylated phenol-formaldehyde or naphthol formaldehyde condensation to the anionic surface active agents is 1:1 to 50:1.

11. The process of claim 9, wherein the pH of the solution is no higher than 6.

12. The process of claim 9, wherein the fiber is a polyamide fiber.

13. The process of claim 9, wherein the sulfomethylated phenol-formaldehyde or napthol-formaldehyde are derivatives of the formula:

$$[R]_n—CH_2SO_3M$$

Where R is a phenolic derivative such as naphthol, alkylnaphthol,thiodiphenol, alkylthiodiphenol, phenol, alkylphenol, 4,4'-dihydroxydiphenyl sulfone, alkyl 4,2'-dihydroxydiphenyl sulfone, bisphenol 'A', alkylbisphenol 'A' and n=1 to 6; and M is H, an alkali metal, —$NH_4$ or an amine (primary, secondary or tertiary).

14. The process of claim 9, wherein the anionic surface active agent is:

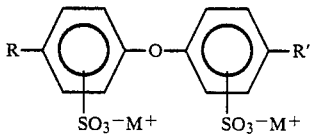

where at least one of the radicals, R and R', is an alkyl chain, branched or linear, with 4 to 18 carbons, where one of the radicals, R or R', may be H and where M is H, or a alkali metal or $NH_4$ or a amine.

15. The process of claim 9, wherein the anionic surface active agent is an alkyl-aryl sulfonate of the following formula:

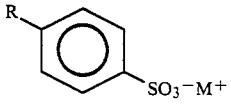

where R=alkyl chain, branched or linear, with 4 to 18 carbons, and M=H, or an alkali metal, or $NH_4$ or an amine.

16. The process of claim 9, wherein the anionic surface active agent is:

$$[R]—SO_3^-H^+ \qquad [III]$$

Where R may be an aliphatic branched or linear chain $C_nH_{2n+1}$ where n=4 to 18 or R may also be an alkyl-aryl branched or linear chain

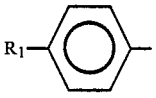

where $R_1$ is $C_nH_{2n+1}$, and where n=4 to 18.

17. The process of claim 9, wherein the anionic surface active agent is a non-aromatic sulfonates including alchohol sulfates and alfa-olefin sulfonates.

18. The process of claim 9 comprising the addition of 2–25 weight % of glycol or glycol ester type solvents.

19. The process of claim 9 comprising the addition of 2 to 25% by weight of ethylene glycol, diethylene glycol, propylene glycol or esters of the above.

* * * * *